United States Patent [19]

Hsiue

[11] 3,998,141

[45] Dec. 21, 1976

[54] BATCH DELIVERY

[75] Inventor: Paul Yung Hsiue, Dayton, Ohio

[73] Assignee: Harris Corporation, Cleveland, Ohio

[22] Filed: June 19, 1975

[21] Appl. No.: 588,346

[52] U.S. Cl. ..... 93/93 M; 93/93 R; 271/179; 271/182; 271/202

[51] Int. Cl.[2] ..... B31B 1/98

[58] Field of Search ..... 271/179, 182, 202, 203; 93/93 R, 93 M, 93 C, 93 DP, 93 D

[56] References Cited

UNITED STATES PATENTS

| | | | |
|---|---|---|---|
| 3,280,679 | 10/1966 | Huffman | 93/93 R X |
| 3,313,221 | 4/1967 | Gubeli | 93/93 DP |
| 3,595,568 | 7/1971 | Roskam | 271/203 X |
| 3,748,973 | 7/1973 | Kuck | 93/93 DP |
| 3,768,382 | 10/1973 | Zernov et al. | 93/93 DP |
| 3,772,971 | 11/1973 | Dutro et al. | 93/93 DP X |
| 3,830,144 | 8/1974 | Kuckhermann et al. | 93/93 DP |
| 3,831,505 | 8/1974 | Skogsberg | 93/93 DP |
| 3,948,153 | 4/1976 | Dutro et al. | 93/93 C |

*Primary Examiner*—James F. Coan

[57] ABSTRACT

An apparatus and method are disclosed for receiving a continuous stream of forms at high speed and automatically stacking the forms into discrete batches of accurate count. The forms are first shingled into a uniform and accurate shingle by spiral screws, kickers, rollers, and hold down tapes which positively and forcefully drive the forms uniformly and accurately onto a conveyor. The forms are then stacked and collected on a vertically reciprocable tray until the desired count is reached, at which time finger hooks intercept and engage the shingle to stop the leading edges of the forms destined for the next batch. A conveyor diverting roller separates the leading edges of the forms for this purpose. Those forms downstream from the finger hooks are then quickly swept onto the elevator tray which deposits them on a discharge conveyor for delivery from the apparatus.

31 Claims, 20 Drawing Figures

BATCH DELIVERY

BACKGROUND OF THE INVENTION

The present invention relates to the art of batching and delivering continuous streams of discrete forms, and more particularly to an apparatus and method for batching a continuous stream of such forms (which may be individual sheets, signatures, multiple business forms, etc.) as they are delivered at high speed. The forms may be received directly from a printing press, collator, or other appropriate source.

The prior art contains numerous examples of devices which batch such streams of forms. Nevertheless, with continuous improvements in printing presses, collators, and so on, has come the need for ever increasing speeds and versatility in such batch delivery devices. This is particularly the case when the forms are numbered serially. That is, for unnumbered forms, it is usually satisfactory if the overall average count (e.g. 50 per box) is correct, although the count in any given box may differ. However with serially numbered forms, it is important that the number of forms in each batch is accurate, so that each batch will contain the correctly numbered forms for that batch. However, the faster the forms are delivered, the more difficult it is to intercept the stream of forms at just the right point each time to give the required accuracy.

Another problem resulting from increased delivery speed is the ability of the personnel operating the batch delivery apparatus to keep up with it. Many prior art devices require considerable operator participation during the forming, delivering, and removal of the batches. The abilities and stamina of the operator can thus impose upper limits on the speeds at which many of these devices can be operated.

SUMMARY OF THE INVENTION

The present invention provides a method and apparatus for accurate batch delivery of continuous streams of forms. The invention fulfills the above requirements by providing accurately formed, counted, and stacked batches at speeds compatible with conventional high speed sources. This is accomplished by carefully shingling the forms into an accurate shingle, quickly and accurately interrupting the movement of the shingle at the proper count, minimizing the distortion of the shingle during its interruption, quickly forming and clearing the stack, and resuming the flow of the shingle.

As the stream of forms is supplied to the batch delivery apparatus, it is a rapidly moving, uniformly spaced series of discrete members. The present invention overlaps these forms serially to form a slower moving shingle which is formed into a stack at a subsequent station in the apparatus. However, in order to maintain an accurate count in each batch, it is essential that the shingle be accurate and uniform. This is accomplished by forcibly driving the individual forms down on top of one another by spiral screws which are driven synchronously with the delivery of each form thereto. The spirals drive the forms onto one another on a conveyor moving at a moderate speed. As the forms are being driven down, a pair of rollers catches each form in a nip at the conveyor to slow the forms instantly to the conveyor speed. The roller nip also assures that the forms are kept squared as they are shingled onto the conveyor. Dragger tapes and rotating kickers operate in conjunction with the spirals to assist further in forcibly driving the forms onto the conveyor at precisely uniform intervals in accordance with their receipt into the batch delivery apparatus. The kickers and tapes hold down and depress the buckle which tends to form in the middle of each sheet due to air trapped beneath as the sheet is driven down by the spirals. The accuracy and uniformity of the shingle are further enhanced by side patters or joggers which pat the side of the shingle as it is carried away from the spirals and kickers by the conveyor. Since this is the first conveyor on which the shingle appears, it is referred to as the first or shingling conveyor.

Somewhat downstream from the spirals the shingle of forms is transferred to a sweep conveyor which has a transverse roller approximately midway therealong to divert the conveyor and the shingle thereon through a modest angle, on the order of twenty degrees. This causes the leading edges of the forms to separate form (rise above) the forms beneath as the shingle is carried around this angle on the sweep conveyor.

At the location where the edges of the forms separate, a pair of rotating finger hooks follows the shingle and is adjusted for accurately and controllably engaging the separated edges of preselected froms to interrupt and stop further movement of the engaged forms. In view of the high speed at which the batch delivery apparatus operates, the finger hooks must operate quickly and accurately to be certain that exactly the right forms are stopped each time. Stoppage of the forms creates a gap which defines the end of one batch and the beginning of the next. As soon as the finger hooks have engaged and stopped the forms to generate this gap, the sweep conveyor is speeded up momentarily in order quickly to sweep the forms remaining downstream thereon away from the forms stopped by the finger hooks.

The finger hook structure is designed to engage and interrupt the shingle accurately but gently. That is, since the forms are often multiple copy forms containing pressure sensitive transfer media (e.g. carbon paper), it is important that the finger hooks leave no impression marks upon the forms. At the same time, it is essential that the forms be intercepted at exactly the right place in the shingle. The finger hooks are therefore arranged in assemblies located at several laterally adjustable locations across the path of the shingled forms. The finger hook assemblies are rotated in synchronization with the batch delivery apparatus so that the peripheral speed of the hooks is slightly faster than the speed at which the shingle moves on the sweep conveyor. Each hook is then adjusted and synchronized to start slightly behind the leading edge of a form immediately preceding a certain predetermined form. When the single is to be interrupted, the rotation of the finger hooks is abruptly halted just in time for the finger hook to catch the predetermined form. Considerable accuracy is thus afforded since the relative velocity between the finger hooks and the forms is quite small, providing a reasonably large time interval in which the mechanism may be operated to stop movement of the finger hooks to interrupt the shingle.

In the preferred embodiment each finger hook assembly .includes finger hooks disposed 180° apart. These are cantilevered from a common mounting block by pairs of links which permit the finger hooks to "float", within limits, free of the mounting block. Thus, as the finger hooks engage the forms they rest lightly thereon with the pressure only of their own weight, so that no impression marks are made. The links provide a parallelogram-like suspension from the mounting block which also permits the finger hooks to seek the proper height for the number and thickness of forms present at that moment on the sweep conveyor. This suspension system also allows the finger hooks to drop subsequently toward the sweep conveyor surface as the downstream forms beneath the finger hooks are swept into the collection platform. This helps prevent the engaged forms from curling underneath the finger hooks during or following the sweep motion of the sweep conveyor.

The back sides of the finger hooks are curved to be generally coincident with the arc through which they move in order to reduce the likelihood that sharp corners or edges might mark pressure sensitive forms. The noses of the finger hooks are also tapered to assist in the proper entry between the separated leading edges of the forms. The tapered noses guide the form which is to be engaged smoothly onto the finger hooks so that no impression marks are made thereon.

The finger hook assemblies in the preferred embodiment are rotated once for each 10 forms which pass therebeneath, so that every fifth form is momentarily contacted by one or more finger hooks (according to how many laterally displaced finger hook assemblies are being used). Thus, the count may be done in multiples of five: if the shingle is not to be interrupted, the finger hook assemblies keep on rotating; if the desired count has been reached, the finger hook drive is interrupted, and the finger hooks braked, as indicated above, as soon as the finger hooks have rotated far enough to overtake the form they are to stop.

A vertically reciprocable tray or collection platform is positioned downstream from and somewhat below the sweep conveyor and receives the shingle as it is conveyed to it from the sweep conveyor. The shingle is formed into a stack on the ray, and the stack is jogged while on the platform to cause the forms to collect uniformly and squarely in the stack.

As soon as the stacking of a batch is completed, it must be quickly removed from the platform so that delivery of the forms to the platform may be resumed before too many of them back up behind the finger hooks. The platform is therefore quickly reciprocated downwardly to transfer the batch of forms onto a discharge conveyor. The discharge conveyor then quickly advances the stacked batch away from the platform and the platform quickly rises again to its original position.

As soon as the collection platform has resumed its normal position the finger hooks resume their rotation to release the forms for advancement onto the collection platform. This completes one machine cycle.

As the next batch is forming on the platform, the machine operator removes an earlier formed batch from the discharge conveyor. The discharge conveyor operates intermittently, moving forward quickly each time a batch is removed from the collection platform, and then stopping quickly. This carries the batches forward periodically toward the discharge end of the batch delivery apparatus for convenient removal by the machine operator while the batches are stationary.

In order to assist with the "make ready" (preliminary adjustments and setting up of the machine), the present invention also includes an intermediate conveyor located between the shingling and sweep conveyors. The intermediate conveyor operates at the same speed as the shingling and sweep conveyors when the forms are passing to the collection platform. However, when the finger hooks are stopped to interrupt the stream of forms, the shingling and intermediate conveyors are driven at a speed approximately half their normal speed. This slows the rate of delivery of forms to the finger hooks to prevent an excessive accumulation of forms at the hooks during the collection platform clearance phase.

The batch delivery apparatus thus operates in essentially two modes. In the first mode the conveyors all operate at the same speed and the shingle passes regularly and uninterruptedly onto the collection platform where the forms are jogged into a well-formed stack. Previously formed stacks (batches) of forms wait motionless on the discharge conveyor for removal. A counter registers the machine cycles (or other appropriate input) to count the forms as they pass through the apparatus.

When the desired count is reached, the counter triggers a cycle control mechanism for the batch delivery apparatus which places it in a second operational mode. In this mode the finger hooks are stopped to engage the separated leading edges of the forms on the sweep conveyor to stop further movement of these forms in order to interrupt their flow as part of the batching operation discussed above. The second mode also causes the shingling and intermediate conveyors to be operated at half speed, and causes the sweep conveyor to be driven momentarily faster than its speed in the first mode in order to sweep itself clear of those forms not caught by the finger hooks. Following this sweep the sweep conveyor returns to its original speed for the duration of the second mode.

Following the rapid sweep of forms from the sweep conveyor, and during the latter part of the second mode, the collection platform reciprocates downwardly to deposit the now completed batch onto the discharge conveyor, and this and the other batches on the discharge conveyor are then quickly cycled forward one step. The now clear collection platform is then quickly raised to its original position and the batch delivery apparatus is returned to the first mode for resumption of delivery of the shingled forms to the collection platform.

It is therefore an object of the present invention to provide a batch delivery apparatus which delivers accurately sized and counted batches from continuous streams of forms supplied at high speed; which employs spiral screws to drive the forms individually onto a shingling conveyor to form an accurate and uniformly spaced shingle; which uses kickers to assist the spirals in the formation of an accurate shingle; which uses nip wheels to stop and form the forms into an accurate shingle; which uses rotating finger hooks which are gravitationally biased toward the shingle to seek the proper height with respect thereto, according to the thickness of the forms, for interrupting the shingle each time a batch is to be formed; which moves the finger hooks into position on the shingle at nearly the same speed at which the shingle is moving; which separates the leading edges of the forms in the shingle to assist the finger hooks in accurately interrupting the flow of the shingle for forming batches of accurate and uniform count; which employs a two speed conveyor to slow delivery of the shingle during the second mode of operation to prevent accumulation of an inordinate number of forms at the finger hooks; which incorporates finger hooks which may be interposed into the shingle accurately and rapidly, and without marking a pressure sensitive form; which properly batches and stacks the forms before delivery from the machine so that high speed operation is possible without overwhelming the machine operator; and to accomplish the above objects and purposes in a versatile apparatus readily suited for use with a wide variety of machines adapted for the production of a continuous stream of forms.

DESCRIPTION OF THE PREFERRED EMBODIMENT

Figure 1:
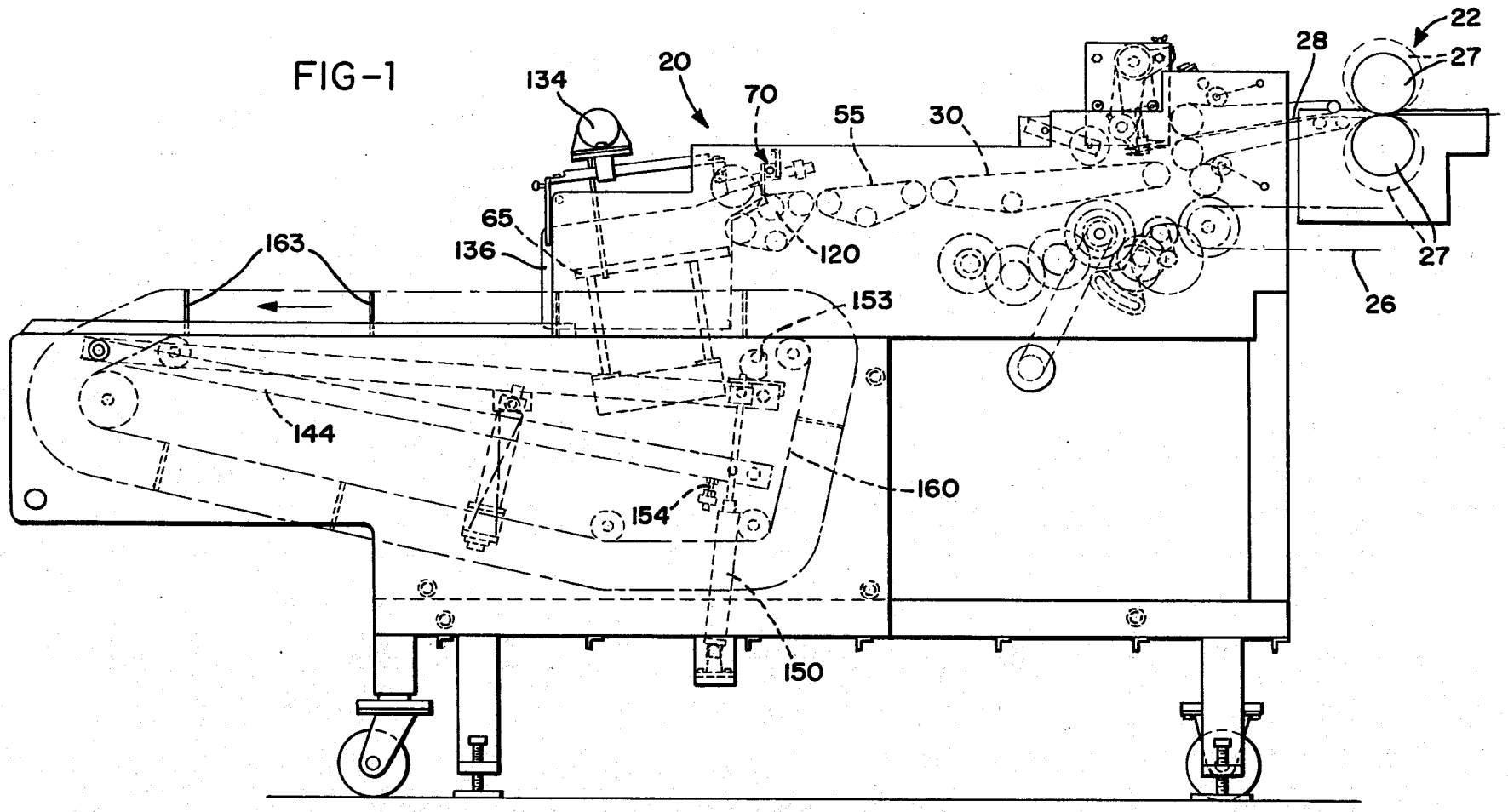
FIG. 1 is a somewhat schematic side view of the batch delivery apparatus illustrating the relative positions of the major components.

The batch delivery apparatus 20, illustrated overall in FIG. 1, is positioned adjacent a device such as a collator 22 for delivering a continuous stream of discrete forms 25 to the batch delivery apparatus 20. In order to maintain precise synchronization between the batch delivery apparatus 20 and the collator 22, the collator provides the main drive for the batch delivery apparatus through a drive chain 26.

Collator 22 typically includes a pair of cutoff cylinders 27 (several sizes being illustrated in FIG. 1) which sever a continuously supplied web into the discrete forms 25. As used herein, the term "forms" is meant broadly to include single layer sheets or tickets, multiple layers, signatures, etc.

As the forms 25 leave the cutoff cylinders 27, they are received between infeed conveyors 28 which move at a velocity slightly faster than the velocity of the forms as they exit from the cutoff cylinders 27. The purpose of the increased velocity of infeed conveyors 28 is to separate the forms 25 from one another to facilitate shingling thereof as they are subsequently overlapped onto a shingling conveyor 30.

Figure 4:
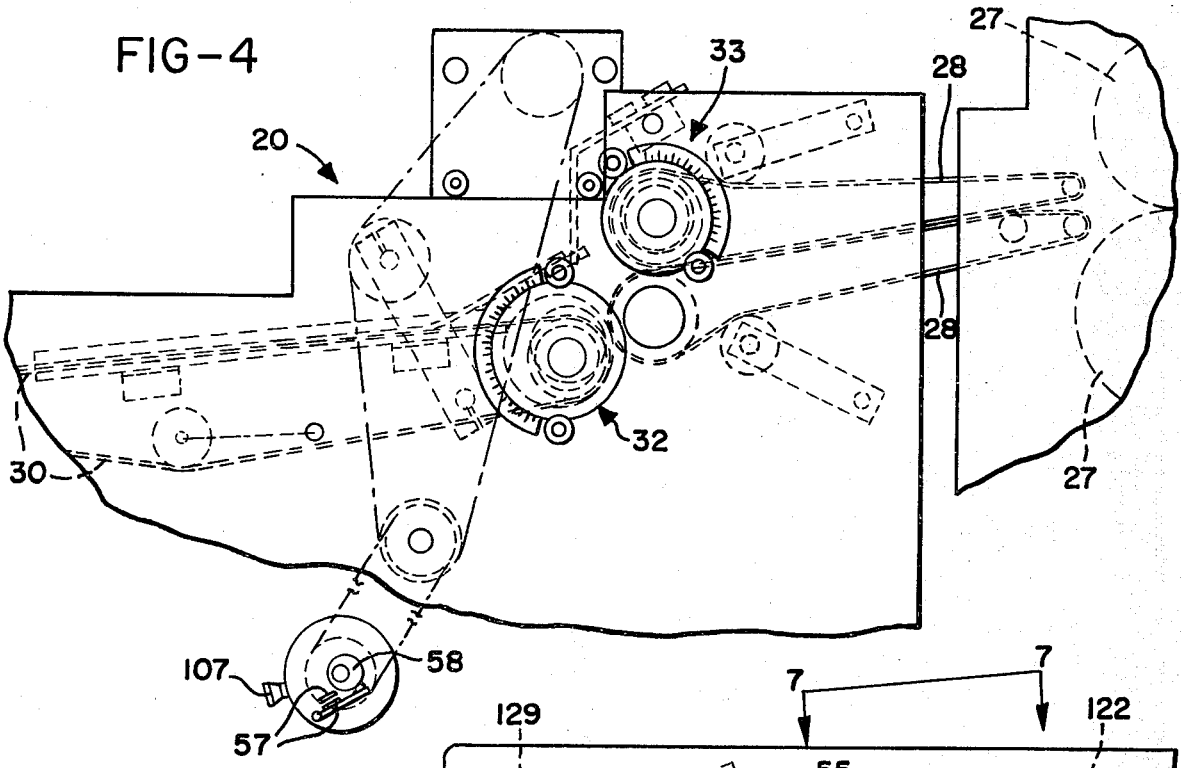
FIG. 4 illustrates portions of the mechanism on the receiving end of the batch delivery apparatus, including the mechanism for accommodating forms of different sizes and thicknesses.

FIG. 4 illustrates generally an eccentric adjusting device 32 which is provided for adjusting the relative vertical positions between conveyors 28 and 30. An eccentric adjusting device 33 adjusts the pressure between infeed conveyors 28 for gripping the forms. Such eccentric adjustments are commonly known in the art for this purpose and are therefore not discussed further.

In order to cause the forms 25 to overlap onto one another in an accurate and uniformly spaced shingle 34 on conveyor 30, the forms are affirmatively driven onto conveyor 30 by means of rotating spiral screws 35 located at the upstream end thereof. With reference to FIGS. 1, 3, 10, and 11, the screws are synchronously driven by drive chain 26 to execute one revolution per form. Thus each formm is positively driven down onto conveyor 30 regardless of any tendency to fly or float as a result of the very high speed at which the batch delivery apparatus 20 and collator 22 may be operated.

Proper formation of the shingle of forms is further aided by means of hold down wheels 17 and hold down straps 38 (FIG. 2A) which guide the leading edges of the forms down onto the shingling conveyor 30. As will be appreciated, at normal press operating speeds these forms are literally flying through the air as they are discharged by infeed conveyors 28. Wheels 37 and straps 38 thus assist in guiding the forms onto conveyor 30. The wheels form a nip with conveyor 30 to catch and align the forms thereon, and the straps 38 guide the forms into the nip and also help retard the forms to the much slower speed of conveyor 30. In the preferred embodiment, the hold down straps 38 are flexible strips of polyurethane approximately ¾ inch wide and 3/16–¼ inch thick.

Proper formation of the shingle 34 is further enhanced by kickers 40 which are synchronized to depress the tail ends of the forms 25 near their centers to drive them down onto conveyor 30 before the leading edges of the subsequent forms arrive. This asures that air trapped beneath the forms as their sides are driven down by the spirals will not prevent the forms from stacking properly onto one another, and that the proper and uniform spacing of the forms into the shingle 37 will therefore be accomplished. The straps 38 are also positioned near the centers of the forms to assist in depressing them.

Figure 10:
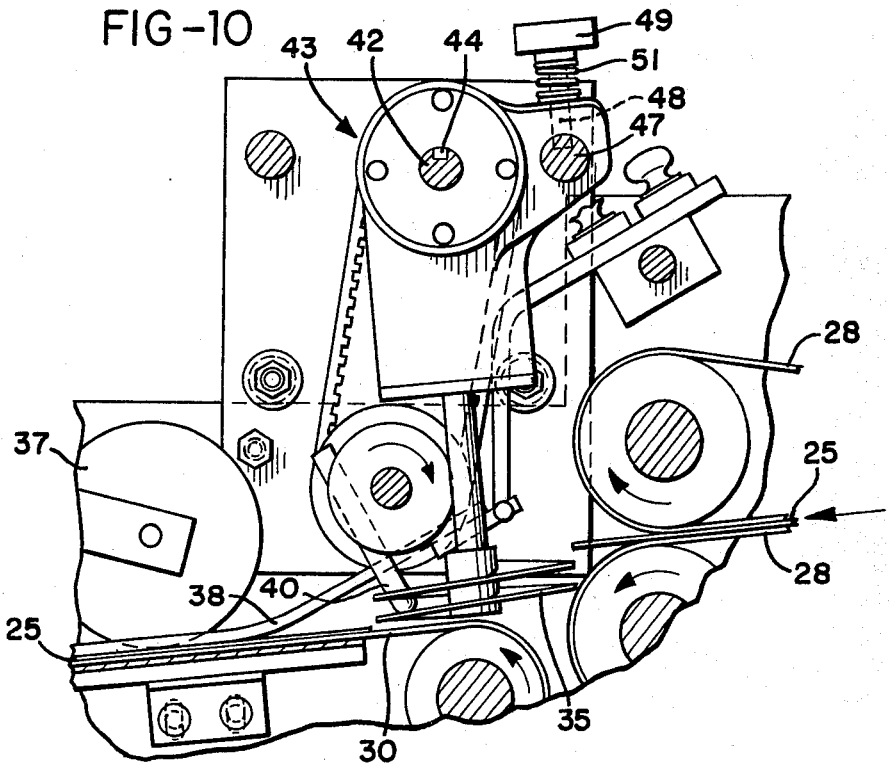
FIG. 10 is an enlarged fragmentary detail of the spiral screws, hold down wheels, tapes, and kicker mechanisms.
Figure 11:
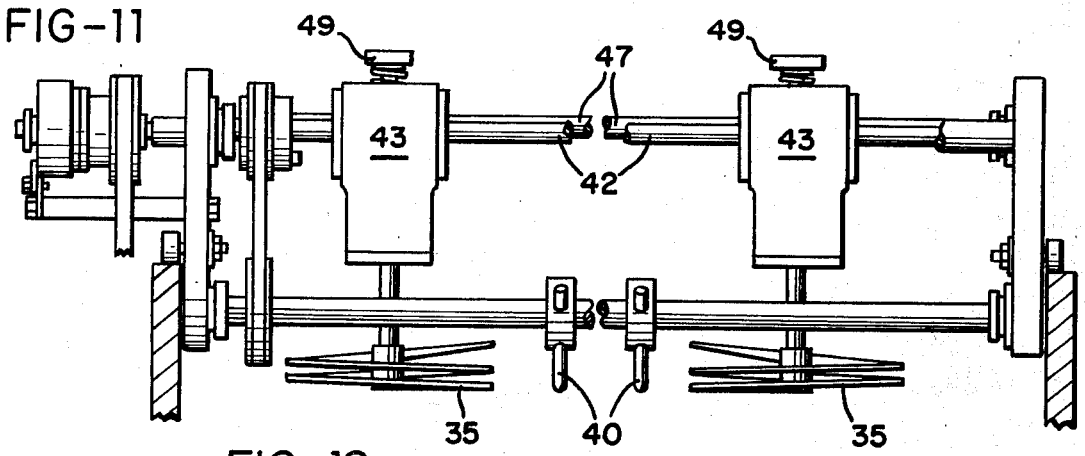
FIG. 11 is a view of the spiral and kicker assembly of FIG. 10 taken on the view line 11—11 of FIG. 2A.

As discussed earlier, the forms may be of many different lengths, as suggested by the differently sized cutoff cylinders 27 illustrated in FIG. 1. Likewise, the forms may be of many different widths, and the various elements of the batch delivery apparatus 20 are therefore laterally adjustable to accommodate the particular width of form being processed. This is accomplished by mounting the various components, such as the spiral screws 35 and kickers 40, on guide shafts and slotted drive shafts extending across the width of the machine, so that these components may be placed as desired. For example FIGS. 10 and 11 show a drive shaft 42 for the drive assemblies 43 of the spiral screws 35. Shaft 42 has a slot 44 in which a key (not shown) in each assembly 43 is engaged. A slotted guide shaft 47 receives an adjustment screw 48 for locking the drive assembly in the desired position. Adjustment screw 48 has a head 49 by which is may be easily tightened or loosened, and it is retained in position by means of a holding spring 51. Such adjustment means are employed throughout the batch delivery apparatus 20, as may be seen from the drawings, and will therefore not be discussed further.

Once the shingle 34 is formed, shingling conveyor 30 delivers the shingle to an intermediate conveyor 55. Both conveyors 30 and 55 are driven at either a first speed or a second speed which is half the first speed. In either case the conveyors are driven from collator 22 by means of drive chain 26. The choice of drive speeds is effected by a conventional counter 56 (FIG. 19) which operates to count the number of forms being received by the batch delivery apparatus 20. The forms may be counted in any manner, and in the present invention are counted by means of counting contacts 57 (FIG. 4) actuated by a cam 58 which is synchronously driven with the spiral screw drive assemblies 43 to provide one pulse for each cycle or rotation of the spiral screws 35. The counter then functions as a cycle control means to place the batch delivery apparatus 20 in a first mode until the desired count is reached. Upon reaching the desired count, the counter cycles the batch delivery apparatus momentarily into a second mode in order to terminate collection of the forms in one batch and to initiate the formation of a new batch.

When the cycle control shifts the batch delivery apparatus into the second mode, the shingling and intermediate conveyors 30 and 55 are driven at half their first mode speed in order to reduce the rate at which the forms 25 arrive at intermediate conveyor's downstream end. The change in speed may be effected by any conventional drive system. In the preset invention an overrunning clutch is continuously connected to drive conveyors 30 and 55 at this half rate speed. An electromagnetic clutch is then actuated to drive the conveyors at full speed for operation in the first mode, and simply disengaged for operation in the second mode. When the electromagnetic clutch is engaged the conveyors overrun the overrunning clutch, and when the electromagnetic clutch is disenaged the conveyors slow to the speed of the overrunning clutch, at which point the drive through the overrunning clutch resumes.

Intermediate conveyor 55 delivers the shingled forms to a sweep conveyor 60 for subsequent delivery to a collection platform 65 on which the forms 25 are stacked into discrete batches 66. Sweep conveyor 60 is driven at the same speeds as shingling conveyor 30 and intermediate conveyor 55 when the batch delivery apparatus is in the first mode. When the batch delivery apparatus is shifted to the second mode, sweep conveyor 60 is momentarily driven at a much greater speed to sweep the forms on the downstream end thereof quickly onto the collection platform 65. Following this sweep, conveyor 60 returns to its original speed (usually well before termination of the second mode).

Figure 5:
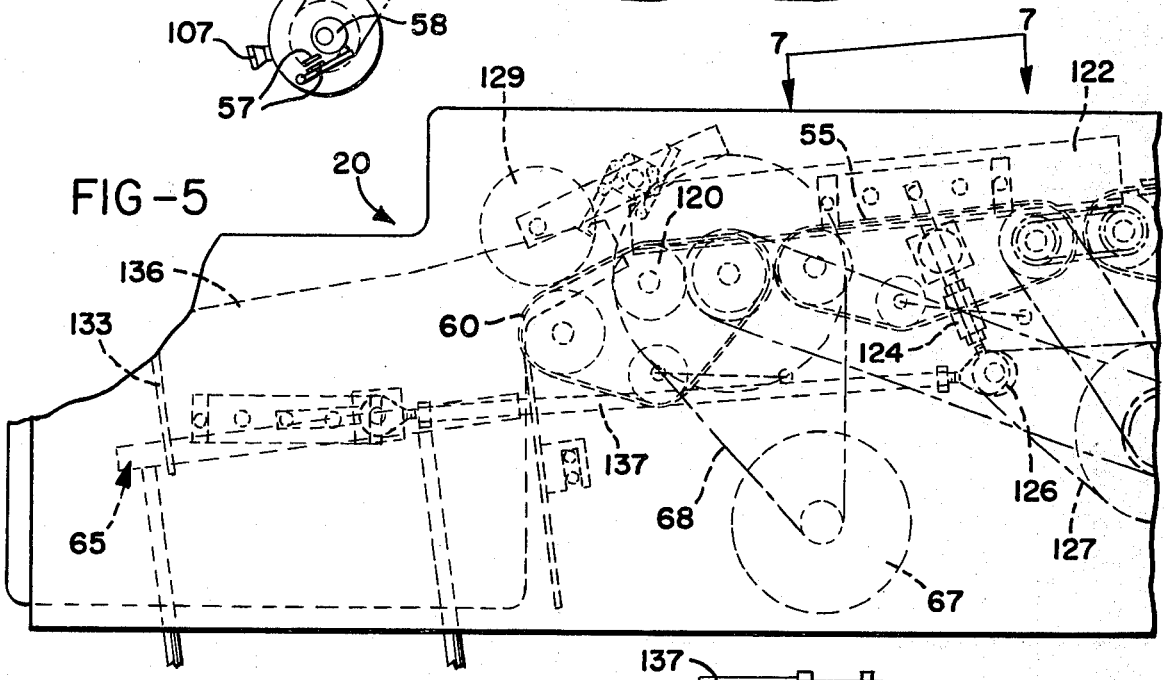
FIG. 5 is a general view illustrating portions of the conveyor and side jogger drives.

As with the rest of the batch delivery apparatus 20, sweep conveyor 60 is driven from drive chain 26. This drive is through an overrunning clutch, and when conveyor 60 is to be driven at its sweep speed, a sweep motor 67 (FIG. 5) is energized to drive conveyor 60 at its sweep speed through a chain 68. During this higher speed operation, conveyor 60 simply overruns its overrunning clutch. Of course, any other well-known drive system may be used for this purpose.

Figure 12:
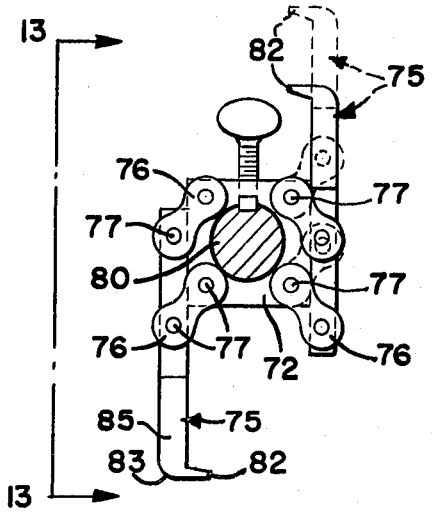
FIG. 12 is a fragmentary detail of the finger hook mechanism.
Figure 13:
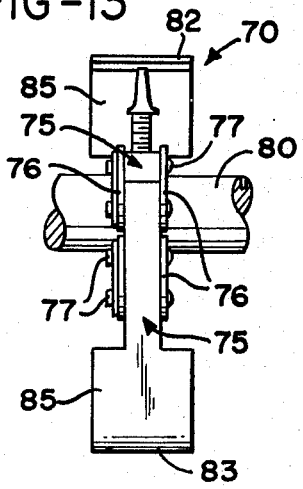
FIG. 13 is a view of the finger hook mechanism taken on view line 13—13 in FIG. 12.
Figure 14:
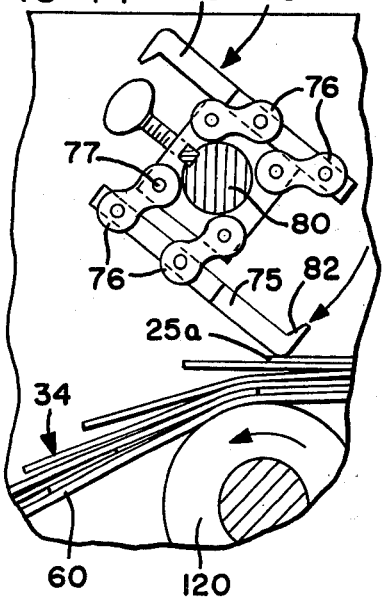
FIGS. 14–16 illustrate sequentially the operation of the finger hooks as they engage the shingle to interrupt the movement thereof.
Figure 15:
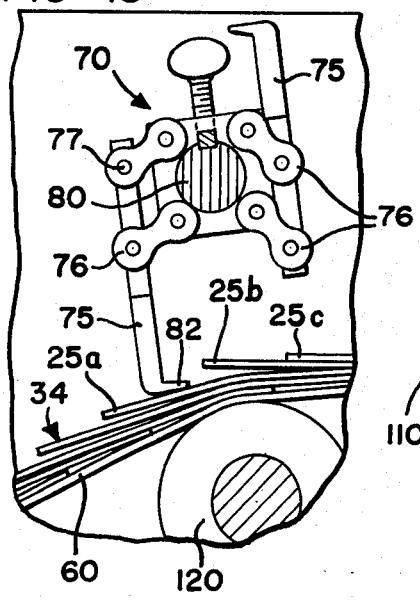
Figure 16:
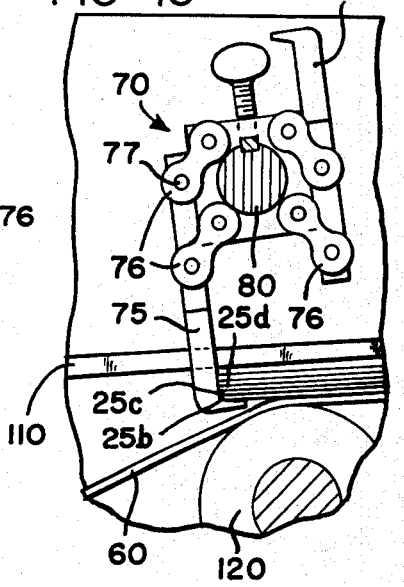

In order to interrupt the flow of forms 25 in the shingle 34 as each batch is being completed on collection platform 65, the batch delivery apparatus 20 includes finger hook assemblies 70 approximately midway therealong. As shown in FIGS. 12–16, assemblies 70 each include a supporting block member 72 on which a pair of finger hooks 75 is supported by links 76. The links 76 are arranged in pairs on either side of each finger hook 75 and are pivoted at 77 to form a movable parallelogram configuration between the finger hooks 75 and supporting members 72. The movable parallelogram configurations permit limited displacement of the finger hooks 75 with respect to the supporting members 72, as is illustrated in FIGS. 12 and 14–16. In FIG. 12, the right hand finger hook member is shown in solid lines in the position it assumes under the influence of gravity, and the opposite position is shown in phantom. This freedom of movement includes a radial component which allows the finger hooks 75 to move naturally and freely under the force of gravity to the proper operating position according to the number and thicknesses of forms being processed by the batch delivery apparatus 20. This is illustrated in FIGS. 14–16, and discussed further below.

The finger hook assemblies 70 are supported and rotated on a finger hook drive shaft 80 at a speed which causes the noses 82 of the finger hooks 75 to move at a velocity slightly greater than that of the shingle 34 when in contact therewith. The back side curvature 83 of the finger hooks is preferably coincident with the arc through which they move, and the finger hook noses 82 are tapered to facilitate entry into the shingle. In addition, the extended portions 85 of the finger hooks 75 are broad shovel-like members 85 which distribute contact with the forms 25 over a wide area. Consequently, the pressures at the points of conact with the forms are very light since they are distributed over wide areas and support only the small weight of the movably mounted finger hooks 75. Point impact forces are also reduced since the finger hooks 75 move at a velocity similar to that of the shingle 34.

In operation, a Maxwell collar 87 (FIGS. 8 and 17) permits the finger hook drive shaft 80 to be adjusted with respect to the shingle 34 so that the initial contact between a given finger hook 75 and a particular form, such as form 25*a* (FIG. 14), occurs with the finger hook nose 82 slightly behind the leading edge of the form 25*a*. Then, during operation of the batch delivery apparatus 20, the finger hook 75 remains well ahead of a particular predetermined form 25*b* due to the hook's slightly greater velocity, as illustrated in FIG. 15. If the shingle is to be interrupted at this point, rotation of the finger hook assembly 70 is then abruptly halted. Form 25*b* catches up with the now stationary finger hook 75 and is caught and stopped thereby. Subsequent forms 25*c* and 25*d*, etc., are also caught to stop movement thereof. This creates a gap in the flow of the shingle to assist in separating one batch from the next. As suggested earlier, this occurs as the batch delivery apparatus 20 is placed in its second mode, and continues until it is restored to its first mode.

Upon restoration to the first mode, the finger hook assemblies 70 once again resume their rotation, and the forms again proceed freely therepast. In the preferred embodiment, finger hook assemblies 70 are rotated once for each ten forms 25 which pass by in the shingle 34. Thus, a finger hook 75 contacts every fifth form. The count may therefore be in any multiple of five.

Figure 8:
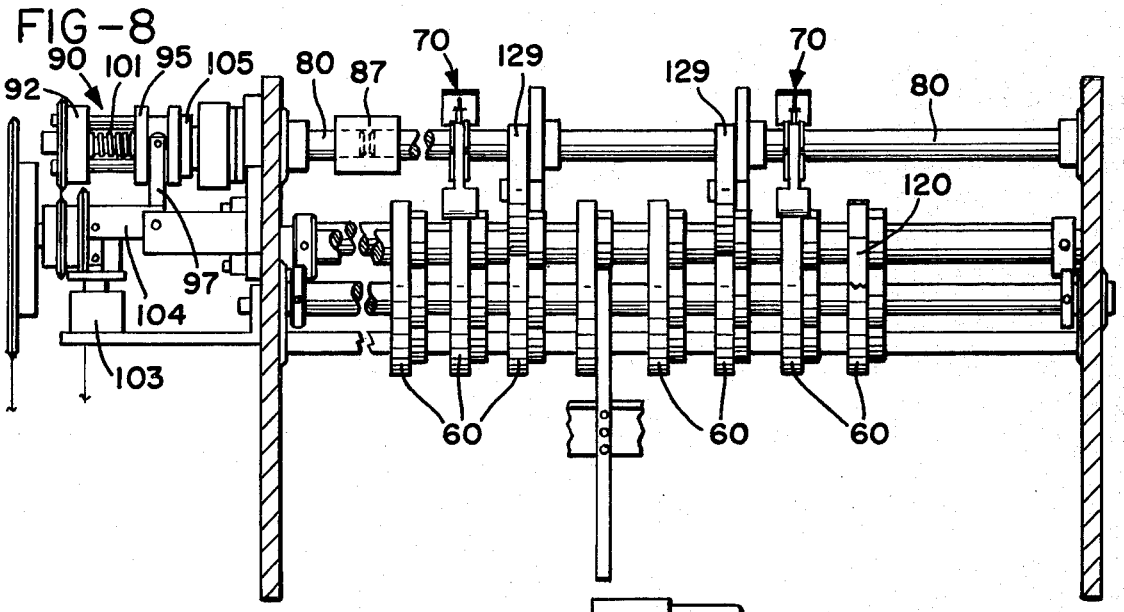
FIG. 8 is a fragmentary sectional view taken on line 8—8 in FIG. 2A.
Figure 17:
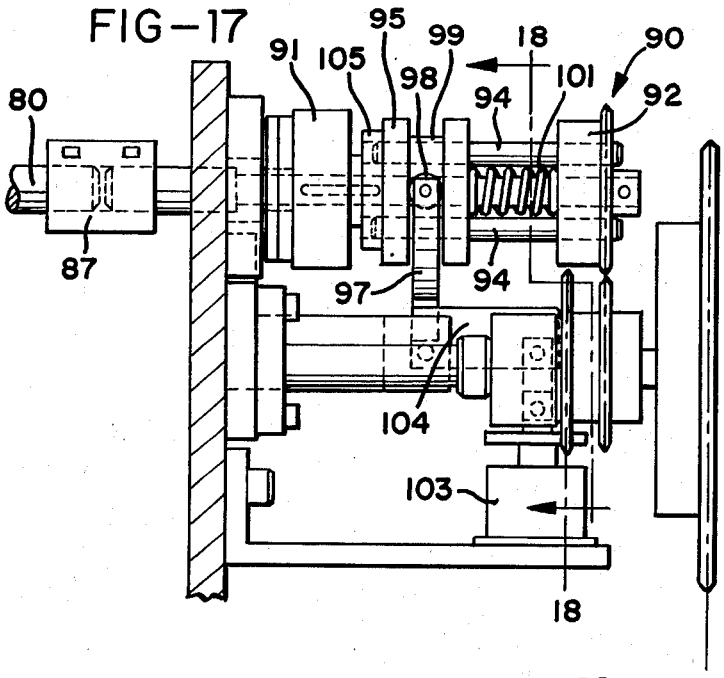
FIG. 17 is a fragmentary detail of the clutch and drive mechanism for the finger hooks.
Figure 18:
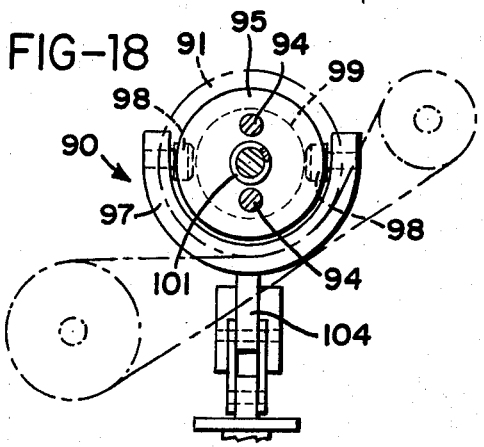
FIG. 18 is a fragmentary sectional view taken on line 18—18 of FIG. 17.

The movement of the finger hook assemblies 70 is regulated by an indexing clutch 90 and brake 91 illustrated in FIGS. 8, 17, and 18. Clutch 90 includes a driven wheel 92 which is synchronously driven in conjunction with the batch delivery drive train powered from collator 22 by drive chain 26. Driven wheel 92 rotates a pair of rods 94 which are axially slidably mounted in wheel 92. An axially movable collar 95 grips and mounts the rods 94 and rotates with the rods in response to the drive from driven wheel 92. A yoke 97 carries rollers 98 in a groove 99 in collar 95 for axially displacing collar 95 against a return spring 101 when a solenoid 103 is actuated to move yoke 97 through a crank 104. When solenoid 103 causes yoke 97 to move collar 95 against spring 101 (in a direction to the right as viewed in FIG. 17), collar 95 withdraws the rods 94 from corresponding axially aligned openings (not shown) therefor in an output wheel 105. Output wheel 105 is driven by the rods 94 when the rods are engaged in the openings therein, and withdrawal of the rods interrupts the drive thereto to interrupt the drive to the finger hook drive shaft 80 and the finger hook assemblies 70 mounted thereon. A brake 91 is engaged just after solenoid 103 is energized in order to stop rotation of shaft 80 and to hold it in position to interrupt the shingle 34.

As indicated earlier, the cycle control for the batch delivery apparatus 20 receives its input from the contacts 57 illustrated in FIG. 4. When the proper count is reached, the solenoid 103 and brake 91 are energized to stop rotation of the finger hook assemblies 70 for interrupting the flow of the shingle 34. If the initial setup of the batch delivery 20 has been properly effected, by using the Maxwell collar 87 (FIGS. 8 and 17) to synchronize the finger hook assemblies 70 with the shingle 34, as illustrated in FIGS. 14 and 15, the batch delivery will function properly and will remain synchronized since all of the main drives are synchronously interconnected. However if fine adjustment of the timing for solenoid 103 and brake 91 is found necessary, this can be easily effected by loosening the lock screw 107 for the contacts 57 (FIG. 4) and rotating the contacts 57 to change their phase slightly with respect to cam 58.

Since the relative velocity between the forms 25 and finger hooks 75 is very small, timing is much less critical than it would be if the relative velocity were greater. That is, there is a longer time interval during which the rotation of the finger hooks may be stopped than would be the case if the relative speed between the shingle and finger hooks were greater.

Figure 6:
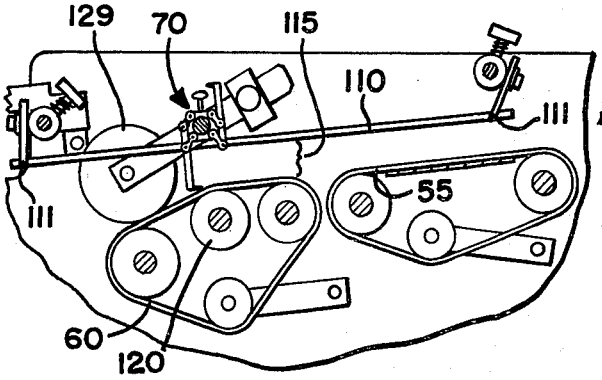
FIG. 6 is a fragmentary view showing the throat over the intermediate and sweep conveyors.

FIGS. 6 and 16 illustrate one of a pair of steel straps 110 which are adjustably pivoted at 111 to define an opening or throat 115 above sweep conveyor 60. Throat 115 prevents the forms from riding and curling up around the finger hooks, and sets an upper limit on the number of forms which may stack up behind the finger hooks 75 when the batch delivery apparatus is in its second mode. When the forms encounter straps 110 they simply begin to taper upstream toward the intermediate conveyor 55.

Figure 3:
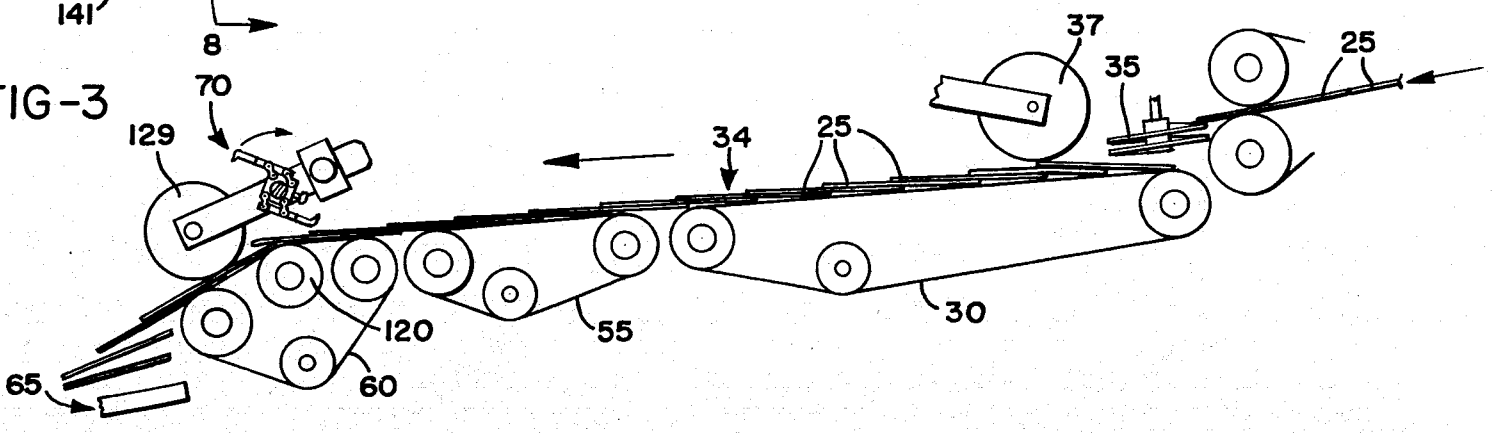
FIG. 3 is a diagrammatic illustration showing the formation and delivery of the shingle of forms on the conveyor.

Entry of the finger hooks 75 into shingle 34 is considerably facilitated by means of a roller 120 located somewhat downstream from the upstream edge of the sweep conveyor 60. Roller 160 diverts conveyor 60 and the shingle 34 thereon through a predetermined angle which causes the leading edges of the forms to separate momentarily from the shingled forms therebeneath, as shown in FIGS. 3, 14 and 15. The finger hook assemblies 70 are then positioned to engage the separated leading edges of the forms as they arrive and are separated at a location at or near roller 120. FIGS. 14 and 15 illustrate the entry sequence of the finger hooks 75 into the single 34, and FIGS. 16 and 2B show the stopped forms collecting at the interposed finger hooks at a somewhat later time during operation of the batch delivery apparatus in the second mode. In fact, FIG. 2B shows the phase immediately following the high speed sweep of conveyor 60 and the completion of a batch 66 of forms on the collection platform 65. Note that as the downstream forms beneath the finger hooks 75 have been swept out from underneath, the finger hooks have dropped to their lower limit, as shown in FIGS. 16 and 2B. This prevents the stopped and engaged forms from sliding or curling out under the finger hooks 75.

Figure 7:
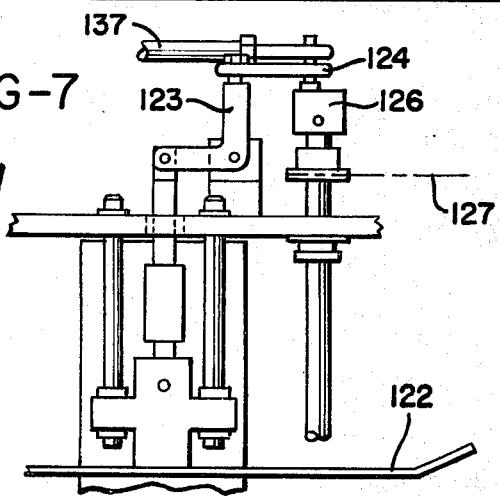
FIG. 7 is a fragmentary plane view taken on line 7—7 of FIG. 5, illustrating the side jogger drive coupling.

Proper entry of the finger hooks 75 into the shingle 37 is also aided by a side patter or jogger 122 (FIGS. 5 and 7) which is reciprocated against the shingle 34 on the intermediate conveyor 55 to square the shingle so that the individual forms thereon are precisely aligned. Thus, by the time the shingle reaches roller 120 it is an accurate, uniformly spaced and squared shingle.

Jogger 122 is reciprocated by means of a crank 123 which is connected through a link 124 to an eccentric 126 which is rotated by a drive chain 127 driven from the drive train in apparatus 20. As eccentric 126 rotates it causes link 124 to oscillate crank 123 which reciprocates the side jogger 122 toward and away from the shingle 34.

Proper ejection of the forms from sweep conveyor 60 onto platform 65 is aided by aluminum hold down wheels 129 which rest on top of the shingled forms 25 at the downstream end of conveyor 60 to assure proper frictional contact between the forms and conveyor. Roller 120 is located downstream from the upstream end of conveyor 60 so that those forms thereon which are not stopped by the finger hooks 75 will be largely or wholly on the sweep conveyor 60 rather than the intermediate conveyor 55. These forms, being downstream from the forms stopped by the finger hooks 75, are destined to be the last forms of the batch which is being completed, and proper and rapid delivery of these forms to that batch is therefore important. Since these forms are on sweep conveyor 60 rather than intermediate conveyor 55, conveyor 60 is able to eject them quickly onto platform 65 during the sweep motion of conveyor 60.

Figure 2A:
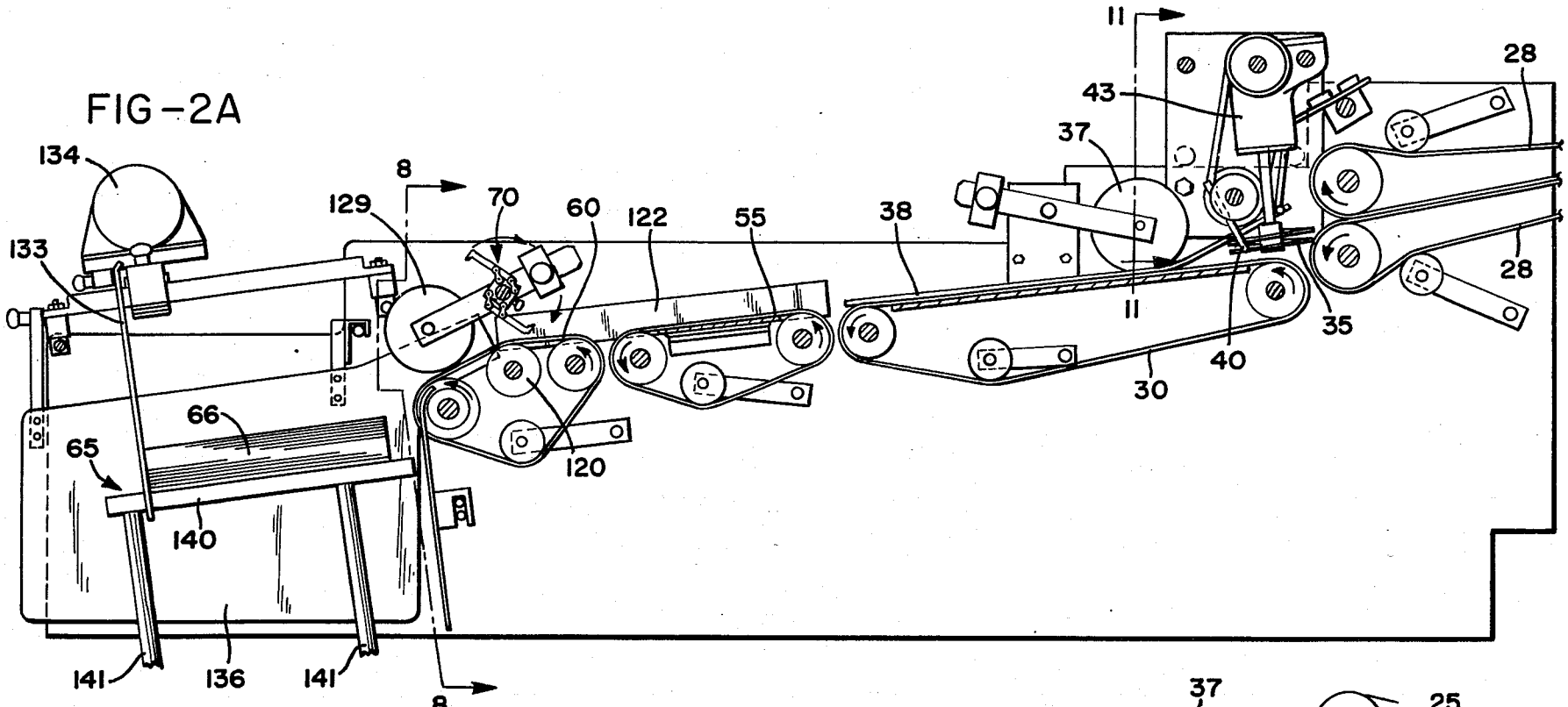
FIGS. 2A and 2B are enlarged detail views of the FIG. 1 assembly, FIG. 2A illustrating the upstream portion and FIG. 2B the downstream portion of the apparatus, the near side wall being removed.
Figure 2B:
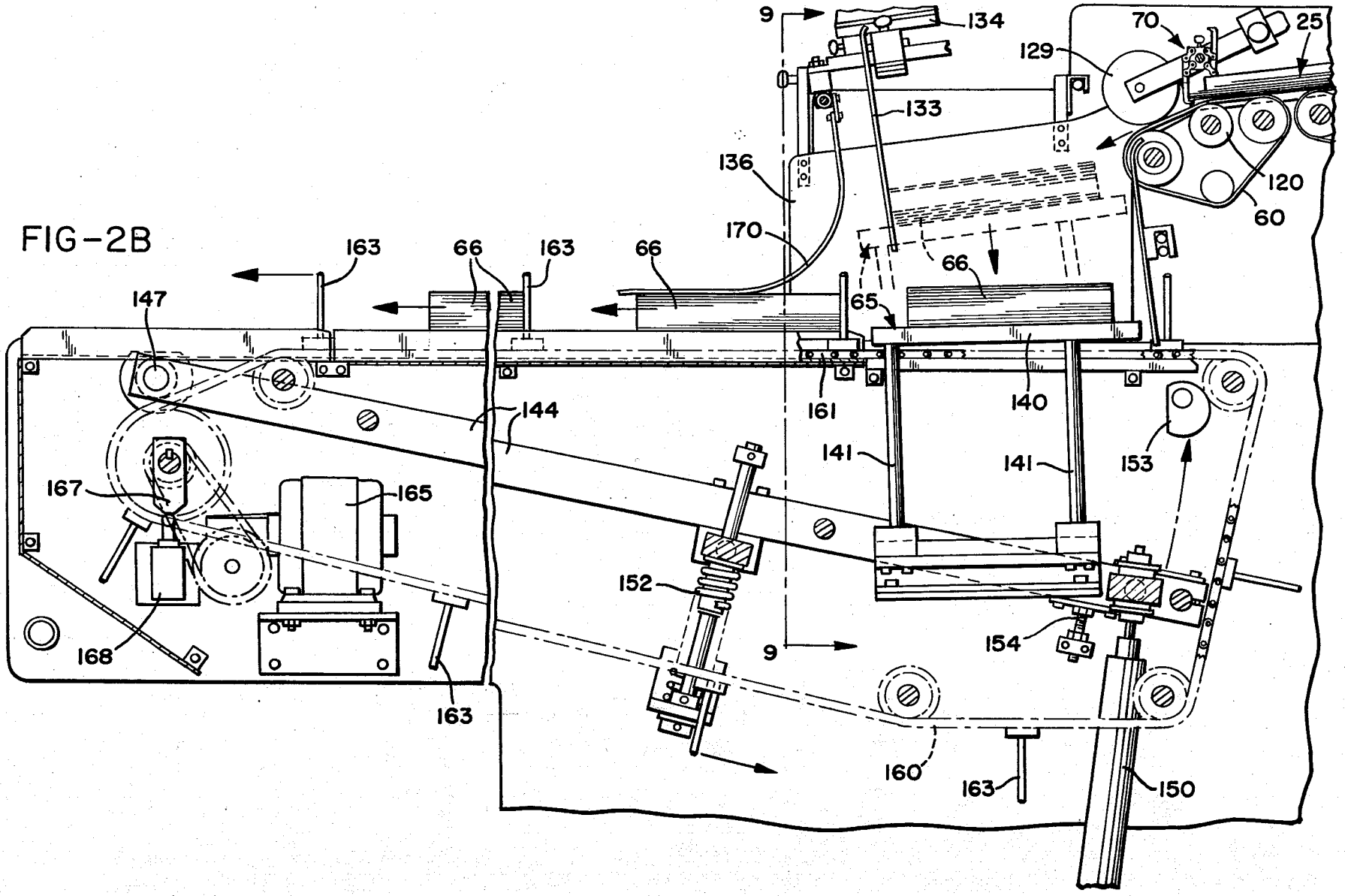

Proper formation of the batch 66 of forms 25 on platform 65 is assured by means of jogger bars 133 which form a back stop for the forms as they arrive on platform 65 and which are jogged by a vibrating jogger motor 134 (FIG. 2A). The jogger bars 133 are sized and adjusted to resonate at the vibrating frequency of the jogger motor to maximize the amplitude of the vibrations.

The batch of forms on platform 65 is also squared by a side patter or jogger 136 (FIG. 5) similar to side jogger 122 and connected by a link 137 (FIGS. 5 and 7) to the same eccentric 126 which drives jogger 122.

Figure 9:
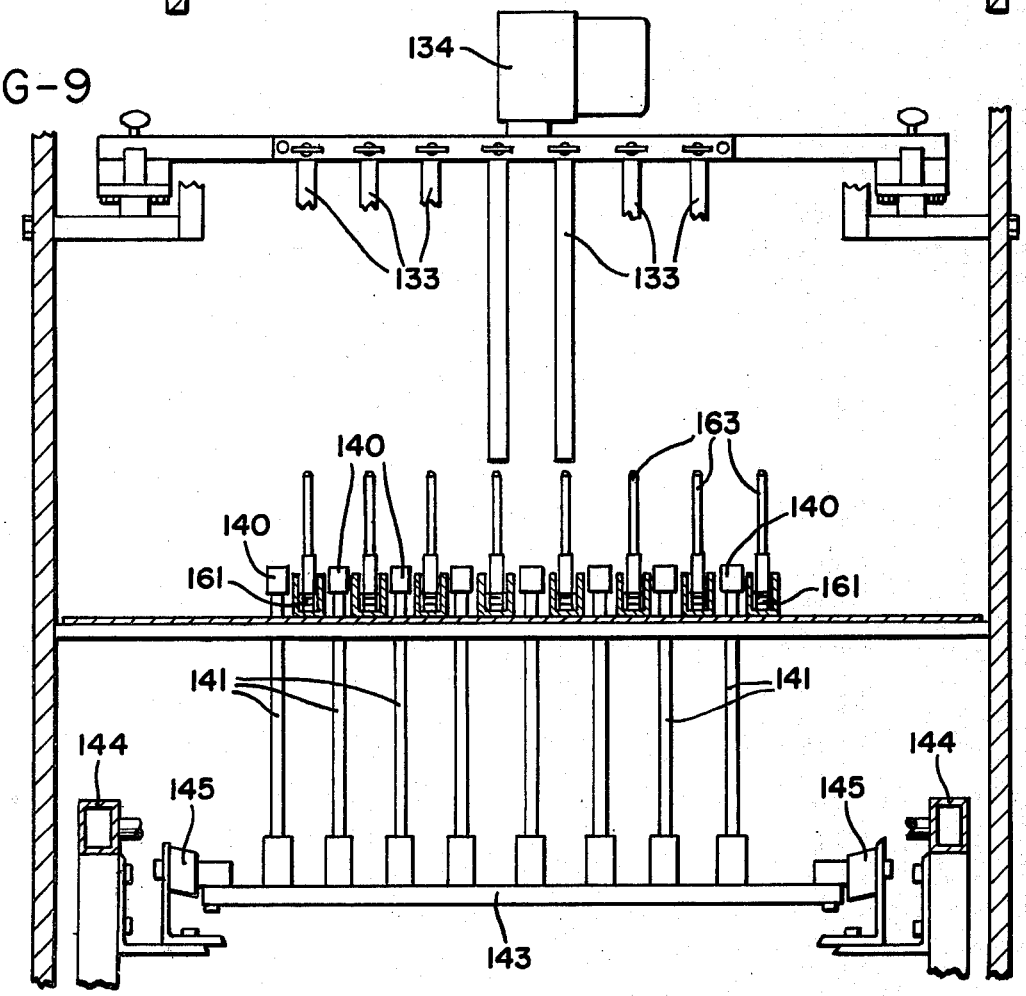
FIG. 9 is a fragmentary sectional view taken on line 9—9 in FIG. 2B.

Collection platform 65 is actually a series of long parallel rectangular bars 140, as may be seen in FIG. 9.

Bars 140 are supported by rods 141 extending from cross beams 143 which themselves are supported on arms 144 by resilient mounts 145. Arms 144 are pivoted at 147 to swing collection platform 65 upwardly and downwardly in response to a two-way collection platform drive cylinder 150. Cylinder 150 is assisted by counter balance springs 152 which offset some of the weight of collection platform 65 and its associated support members. The upper and lower positions for platform 65 are determined respectively by upper and lower limit stops 153 and 154 (FIG. 2B). When the batch delivery apparatus 20 is operating in the first mode, platform 65 is maintained in its upper position (shown in FIGS. 1, 2A, and in phantom in FIG. 2B). When the batch delivery apparatus 20 is operated to its second mode, upon completion of a batch 66, the platform 65 is moved quickly to its lower position (shown in solid lines in FIG. 2B) for removal of the batch therefrom, and then is returned to its upper position at the end of the second mode. The resilient mounts 145 permit rapid motion of the platform 65 by cushioning the shock as the platform reaches the stops.

When platform 65 is in its lower position, the batch is removed from the platform by a discharge conveyor 160. Conveyor 160 is actually a series of narrow conveyor chains 161 all moving synchronously and located between the individual platform bars 140 and rods 141, as may best be seen in FIG. 9. (In fact, all of the conveyors in the present invention are actually composed of groups of rather narrow discrete elements, such as tapes, all moving in parallel, as may be seen in FIG. 8). Discharge conveyor 160 includes spaced groups of pusher bars 163 removably engaged in the conveyor chain 161.

Thus, when the platform 65 is reciprocated downwardly through conveyor 160, the discharge coveyor drive motor 165 is energized to drive conveyor 160 causing pusher bars 163 to push the batch off of platform 65 and downstream toward the discharge end of the batch delivery apparatus 20. As soon as the batch is clear of the collection platform 65, the platform is again reciprocated upwardly and the batch delivery apparatus is returned to its first operational mode.

Operation of discharge conveyor 160 is intermittent and is controlled by a cam 167 which is rotated by the drive train between drive motor 165 and conveyor 160 (see FIG. 2B) to operate a switch 168 which controls the discharge conveyor drive motor 165. Preferably, the discharge conveyor drive train is adjusted to rotate cam 167 one complete revolution each time the discharge conveyor 160 is advanced a distance equal to the distance between successive groups of pusher bars 163. Switch 168 is then able to stop operation of motor 165 each time the pusher bars 163 are advanced one step to the position previously occupied by the row of pusher bars immediately ahead thereof. Optional dragger tapes 170, similar to hold down straps 38, help stop forward movement of the top of the stack or batch of forms 66 as conveyor 160 stops, to keep the upper forms from sliding off. Since the discharge conveyor operation is intermittent, it is relatively easy for the person unloading the batched forms to remove them during those time periods in which conveyor 160 is at rest.

Figure 19:
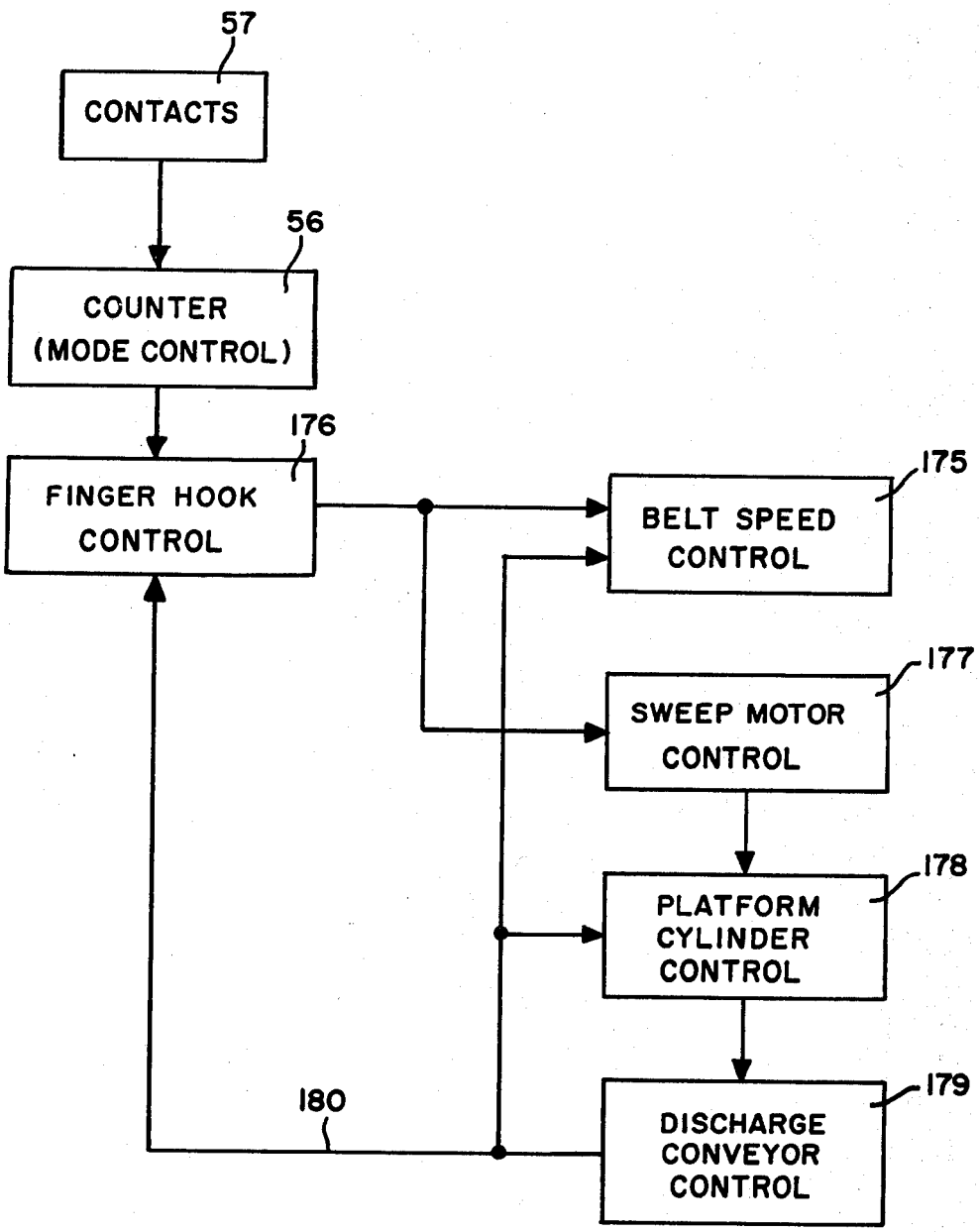
FIG. 19 is a block diagram illustrating the control for the batch delivery apparatus.

FIG. 19 summarizes in block form the control circuitry for the batch delivery apparatus. As shown therein, and as discussed earlier, the contacts 57 provide one pulse to counter 56 for each form received in apparatus 20. The batch delivery apparatus 20 starts in the first mode, and counter 56 leaves it in the first mode until the desired count is reached.

When the desired count is reached, counter 56 places the apparatus in the second mode momentarily, to clear the batch, by triggering the finger hook control 176 to operate the finger hook indexing clutch 90 and the finger hook brake 91 as discussed earlier. This interrupts the shingle flow until it is restored when the apparatus is returned to the first mode.

The finger hook control 176 also causes the belt speed control 175 to shift from the first mode to the second mode. In the first mode the belt speed control 175 operates the shingling, intermediate, and sweep conveyors 30, 55, and 60 at the same speeds, as for example by means of the overrunning and electrically operable clutches discussed above. In the second mode the belt speed control 175 slows the shingling and intermediate conveyors to one half the first mode speed.

Similarly, the finger hook control 176 causes the sweep motor control 177 to energize sweep motor 67 momentarily at the start of the second mode to run the sweep conveyor 60 momentarily faster to complete the batch on the platform 65.

In turn, the sweep motor control 177 causes the platform cylinder control 178 to operate cylinder 150 to reciprocate the platform downwardly to its lower limit stop 154 at the start of the second mode.

The platform cylinder control 178 causes the discharge conveyor control 179 to energize the discharge conveyor drive motor 165 momentarily during this second mode operation to cause the discharge conveyor 160 to move forward one increment, as explained earlier. When conveyor 160 has completed this incremental motion, the discharge conveyor control 179 provides an output 180 (FIG. 19) signifying that the second mode clearance phase is completed. Output 180 then stops motion of the discharge conveyor 160 and also restores the batch delivery apparatus to the first mode by way of controls 175, 176, and 178, as illustrated in FIG. 19 and as discussed earlier.

As may be seen, therefore, the present invention provides numerous advantages. It is capable of operation at very high speeds and can be used with modern high speed machinery. This high speed capability is due in part to the formation of an accurate, uniformly spaced and squared shingle which permits precise interruption thereof by the specially designed finger hooks. The shingle is formed by spiral screws which positively force the forms down onto a shingling conveyor in proper timed sequence. Shingling is further assisted by the hold down wheels, hold down straps, kickers, and side patters.

The finger hooks themselves move quickly and accurately into the shingle without marking the forms. This is aided by the roller 120 which separates the leading edges of the forms in the shingle. Proper operation is also assisted by slowing of the shingling and intermediate conveyors during the sweep and collection platform clearing phase (mode 2), thus relieving congestion in the vicinity of the finger hooks.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. Apparatus for batch delivery of a continuous stream of forms, comprising:

a. cycle control means for alternately placing the batch delivery apparatus in first and second modes,
b. a shingling conveyor,
c. a shingling conveyor drive for driving said shingling conveyor,
d. spiral screw means coordinated with the stream of forms for receiving the stream of forms and depositing each form individually on said shingling conveyor to form a uniform shingle thereon,
e. a sweep conveyor located downstream from said shingling conveyor for receiving said shingle therefrom,
f. means incorporated in said sweep conveyor for diverting said sweep conveyor and the shingle thereon through a predetermined angle for separating the leading edge of each form from the shingled form therebeneath,
g. finger hook means operative when said batch delivery apparatus is in said second mode for engaging the separated leading edges of the forms on said sweep conveyor as they arrive at a predetermined location near said roller means, said finger hook means stopping movement of the engaged said forms on said sweep conveyor until said batch delivery apparatus is returned to said first mode, and
h. means for driving said sweep conveyor at at least a first speed during said first and second modes, and for driving said sweep conveyor momentarily faster at the start of said second mode to rapidly carry the forms thereon which are downstream from said predetermined location away from those forms stopped by said finger hook means.

2. The apparatus of claim 1 further comprising:

a. an intermediate conveyor located between said shingling and sweep conveyors for carrying said shingle therebetween, and
b. two speed drive means for said shingling and intermediate conveyors for selectively driving at least one of said shingling and intermediate conveyors at a speed corresponding to the speed of said sweep conveyors when said batch delivery apparatus is in said first mode, and at a predetermined speed substantially slower when in said second mode.

3. The apparatus of claim 1 further comprising:

a. a generally vertically reciprocating collection platform downstream from said sweep conveyor for receiving and stacking the forms thereon, said platform reciprocating downwardly at the beginning of said second mode and upwardly at the end of said second mode,
b. jogger means for engaging and jogging forms on said collection platform, and
c. discharge conveyor means for receiving said stacked forms from said platform during said second mode.

4. The apparatus of claim 3 wherein said jogger means for engaging and jogging forms on said collection platform includes a vibrating jogger motor and jogger bars supported therefrom for contacting said forms, said jogger bars and motor being adjusted to resonate at the same frequency for maximizing the amplitude thereof.

5. The apparatus of claim 1 further comprising hold down wheel means operating in conjunction with said spirals to guide the forms down firmly and precisely onto said shingling conveyor to form an accurately and uniformly spaced shingle.

6. The apparatus of claim 5 further comprising kickers and dragger tape means operating in conjunction with said spirals and hold down wheel means to guide and drive the forms down firmly and precisely onto said shingling conveyor to form an accurately and uniformly spaced shingle thereon.

7. The apparatus of claim 1 further comprising hold down wheels downstream from said predetermined location for holding forms downstream therefrom in contact with said sweep conveyor to improve the frictional contact therebetween for proper sweeping of these forms away from those forms stopped by said finger hook means.

8. The apparatus of claim 1 wherein said roller means is located downstream from the upstream edge of said sweep conveyor.

9. The apparatus of claim 1 further comprising means mounted above said sweep conveyor upstream from said predetermined location to define a throat for limiting the number of forms which may collect at the finger hooks while said batch delivery apparatus is in said second mode.

10. The apparatus of claim 1 wherein said finger hook means comprises:

a. a support member,
b. at least one finger hook,
c. means supporting said finger hook on said support member for permitting limited displacement with respect thereto in a direction having at least a radial component when said finger hook contacts said forms,
d. means for supporting and rotating said support member and said finger hook to cause said finger hook to rotate about a path which brings said finger hook into contact with said shingle at a velocity similar to that of said shingle, and
e. means for stopping rotation of said support member and finger hook at a predetermined location to cause said finger hook, while in contact with said shingle, to engage the adjacent leading edges of certain predetermined forms in said shingle to stop movement thereof.

11. The apparatus of claim 10 wherein the velocity of said finger hook is slightly greater than that of said shingle while said finger hook is rotating in contact therewith.

12. The apparatus of claim 10 wherein said finger hook includes a tapered nose on the end opposite said support member for entering between the separated leading edges of the forms and for guiding said finger hook smoothly over the forms not engaged thereby.

13. The apparatus of claim 10 wherein said means mounting said finger hook for radial displacement comprises a pair of link members connecting said support member and finger hook to define a parallelogram.

14. The apparatus of claim 10 wherein said finger hook includes a broad shovel-like portion for contacting the forms in the shingle over a wide area to minimize point pressures therebetween.

15. The apparatus of claim 10 wherein said means for rotating said finger hook and its support member includes an indexing clutch for interrupting the drive thereto, said indexing clutch having a number of indexed positions equal to the number of finger hooks on each finger hook support member for automatically restoring the finger hooks to proper synchronization with the batch delivery apparatus when the clutch is reengaged as the batch delivery apparatus is cycled from the second mode back to the first mode.

16. The apparatus of claim 15 wherein said indexing clutch further comprises:

a. a driven wheel, b. an axially movable rod for each of said indexed positions of said clutch, said rods being rotatively drivable by but axially slidably mounted in said wheel, c. an axially movable collar mounting said rods for axial and rotating movement therewith, d. an output wheel having openings therein corresponding to said rods, said openings being axially alignable therewith, and e. means for engaging and moving said collar to urge said rods into said output wheel openings when said clutch is to be engaged and for withdrawing said rods from said openings when said clutch is to be disengaged.

17. Apparatus for batch delivery of a continuous stream of forms, comprising:

a. cycle control means for alternately placing the batch delivery apparatus in first and second modes;

b. a first conveyor, c. a second conveyor located downstream from said first conveyor for receiving said shingle from said first conveyor, d. two speed drive means for said first and second conveyors for selectively driving said conveyors at a first speed when said batch delivery apparatus is in said first mode, and at a predetermined speed substantially slower when in said second mode, e. spiral screw means coordinated with the stream of forms for receiving the stream of forms and depositing each form individually on said first conveyor to form a uniform shingle thereon, f. kickers operating in conjunction with said spirals to drive the forms down firmly onto said first conveyor to form an accurately and uniformly spaced shingle, g. hold down wheel means and dragger tape means operating in conjunction with said spirals and kickers to guide and drive the forms down firmly and precisely onto said shingling conveyor to form an accurately and uniformly spaced shingle, h. side jogger means along said second conveyor to form and keep said shingle uniform and squared, i. a third conveyor located downstream from said second conveyor for receiving said shingle from said second conveyor, j. roller means incorporated in said third conveyor downstream from the upstream edge thereof for diverting said third conveyor and the shingle thereon through a predetermined angle for separating the leading edge of each form from the shingled forms therebeneath, k. finger hook means operative when said batch delivery apparatus is in said second mode for engaging the separated leading edges of the forms on said third conveyor as they arrive at a predetermined location near said roller means, said finger hook means stopping movement of the engaged said forms on said third conveyor until said batch delivery apparatus is returned to said first mode, l. means for driving said third conveyor at at least a first speed during said first and second modes, and for driving said sweep conveyor momentarily faster at the start of said second mode to rapidly carry the forms thereon which are downstream from said predetermined location away from those forms stopped by said finger hook means, m. a vertically reciprocating collection platform downstream from said third conveyor for receiving and stacking the forms thereon, said conveyor reciprocating downwardly at the beginning of said second mode and upwardly at the end of said second mode, n. jogger means for engaging and jogging forms on said collection platform during said first mode, and o. fourth conveyor means for receiving said stacked forms from said platform during said second mode.

18. The apparatus of claim 17 wherein said finger hook means comprises:

a. a support member, b. at least one finger hook, c. link members supporting said finger hook in a parallelogram configuration on said support member for permitting limited displacement with respect thereto in a direction having at least a radial component when said finger hook contacts said forms, d. means including an indexing clutch for supporting and rotating said support member and said finger hook to cause said finger hook to rotate about a path which brings said finger hook into contact with said shingle at a velocity slightly greater than that of said shingle, and e. means including said indexing clutch for stopping rotation of said support member and finger hook at a predetermined location to cause said finger hook, while in contact with said shingle, to engage the adjacent leading edges of certain predetermined forms in said shingle to stop movement thereof.

19. Apparatus for use in the batch delivery of a continuous stream of forms, comprising:

a. a support member, b. at least one finger hook, c. means supporting said finger hook on said support member for permitting limited displacement with respect thereto in a direction having at least a radial component when said finger hook contacts the forms, said finger hook supporting means being a self-biasing supporting means for said finger hook and supporting said finger hook while contacting, engaging, holding, and releasing the forms to keep the point pressures therebetween below the marking pressure of pressure sensitive copy forms, d. means for supporting and rotating said support member and said finger hook to cause said finger hook to rotate about a path which brings said finger hook into contact with the forms at a velocity similar to that of the forms, and e. means for stopping rotation of said support member and finger hook at a predetermined location to cause said finger hook, while in contact with said forms, to engage the adjacent leading edges of certain predetermined forms to stop their movement.

20. The apparatus of claim 19 wherein the velocity of said finger hook is slightly greater than that of the forms while said finger hook is rotating in contact therewith.

21. The apparatus of claim 19 wherein said means mounting said finger hook for radial displacement comprises a pair of link members connecting said support member and finger hook to define a parallelogram.

22. The apparatus of claim 19 wherein said finger hook includes a broad shovel-like portion for contacting the forms over a wide area to minimize point pressures therebetween.

23. The apparatus of claim 19 wherein said means for rotating said finger hook and its support member includes a synchronously driven indexing clutch for interrupting the drive thereto, said indexing clutch having a number of indexed positions equal to the number of finger hooks on each finger hook support member for automatically synchronizing the finger hooks thereon to the passage of the forms thereby when the clutch is reengaged.

24. The apparatus of claim 23 wherein said indexing clutch further comprises:

a. a driven wheel,
b. an axially movable rod for each of said indexed positions of said clutch, said rods being rotatively drivable by but axially slidably mounted in said wheel,
c. an axially movable collar mounting said rods for axial and rotating movement therewith,
d. an output wheel having openings therein corresponding to said rods, said openings being axially alignable therewith, and
e. means for engaging and moving said collar to urge said rods into said output wheel openings when said clutch is to be engaged and for withdrawing said rods from said openings when said clutch is to be disengaged.

25. The apparatus of claim 19 wherein the back side of said finger hook is curved to be generally coincident with the arc through which it moves in order to reduce the likelihood of marking pressure sensitive forms with which the finger hook may come into contact.

26. A method for batch delivery of a continuous stream of forms, comprising:

a. driving the forms by means of rotating spirals onto a conveyor and kicking the forms onto the conveyor following release from the spirals and jogging the sides of the forms on the conveyor to shingle the forms into an accurate, uniformly spaced and squared shingle,
b. advancing the shingled forms at a first speed in a first zone,
c. passing the forms from the first zone to a second zone and advancing the forms in the second zone at a speed corresponding to the speed in the first zone,
d. temporarily and serially separating the leading edges of each form from the shingle by diverting the shingle through a predetermined angle at a predetermined location in the second zone,
e. passing the forms from the second zone to a collection zone and collecting the forms in a stock in the collection zone until a predetermined number of forms has been collected,
f. thereafter temporarily engaging the separated leading edges of certain predetermined forms to stop movement of the engaged forms,
g. moving the forms through the first zone at a predetermined speed substantially slower than the first speed,
h. advancing the forms in the second zone downstream from the engaged forms into the collection zone at a faster speed than the first speed,
i. removing the stacked forms from the collection zone, and
j. thereafter releasing the engaged and stopped forms, again advancing the forms in the first and second zones at the first speed, and passing the forms to the collection zone.

27. A method for batch delivery of a continuous stream of forms, comprising:

a. shingling the forms into an accurate, uniformly spaced and squared shingle,
b. advancing the shingled forms at a first speed in a first zone,
c. passing the forms from the first zone to a second zone and advancing the forms in the second zone at a speed corresponding to the speed in the first zone,
d. temporarily and serially separating the leading edges of each form from the shingle by diverting the shingle through a predetermined angle at a predetermined location in the second zone,
e. passing the forms from the second zone to a collection zone and collecting the forms in a stack in the collection zone until a predetermined number of forms has been collected,
f. thereafter temporarily engaging the separated leading edges of certain predetermined forms to stop movement of the engaged forms,
g. advancing the forms in the second zone downstream from the engaged forms into the collection zone,
h. removing the stacked forms from the collection zone, and
i. thereafter releasing the engaged and stopped forms, again advancing the forms in the second zone, and passing the forms to the collection zone.

28. The method of claim 27 wherein step (f) further comprises moving the forms through the first zone at a predetermined speed substantially slower than the first speed after the predetermined number of forms has been collected.

29. The method of claim 27 wherein step (g) further comprises advancing the forms downstream from the engaged forms into the collection zone at a faster speed than the first speed.

30. Apparatus for use in the batch delivery of a continuous stream of forms, comprising:

a. a shingling conveyor,
b. a shingling conveyor drive for driving said shingling conveyor,
c. spiral screw means coordinated with the stream of forms for receiving the stream of forms and depositing each form individually and sequentially on said shingling conveyor to form a uniform shingle thereon, and
d. hold down wheel means operating in conjunction with said spirals to guide the forms down firmly and precisely onto said shingling conveyor to form an accurately and uniformly spaced shingle thereon.

31. The apparatus of claim 30 further comprising kickers and dragger tape means operating in conjunction with said spirals and hold down wheel means to guide and drive the forms down firmly and precisely onto said shingling conveyor to form an accurately and uniformly spaced shingle thereon.

* * * * *